United States Patent [19]

Schiller

[11] Patent Number: 4,579,265

[45] Date of Patent: Apr. 1, 1986

[54] WEAPON HOLSTER CARRIER

[76] Inventor: Barry Schiller, 6103 Umbrella Tree La., Tamarack, Fla. 33319

[21] Appl. No.: 618,387

[22] Filed: Jun. 7, 1984

[51] Int. Cl.[4] ..... A45C 1/04

[52] U.S. Cl. ..... 224/229; 224/224; 224/222; 224/911

[58] Field of Search ..... 224/229, 222, 224, 243, 224/911

[56] References Cited

U.S. PATENT DOCUMENTS

| | | | |
|---|---|---|---|
| 1,418,371 | 6/1922 | Foster | 224/229 |
| 1,558,228 | 10/1925 | Botkin | 224/229 |
| 2,351,158 | 6/1944 | Stetzer | 224/229 |
| 4,029,242 | 6/1977 | Stoesser | 224/222 |
| 4,341,331 | 7/1982 | McDougall | 224/229 |
| 4,440,525 | 4/1984 | Perla | 224/229 |

*Primary Examiner*—Stephen Marcus
*Assistant Examiner*—David Voorhees
*Attorney, Agent, or Firm*—Samson B. Leavitt; Michael A. Leavitt

[57] ABSTRACT

A body pocket carrier, especially a weapon holster carrier for wearing on a female body part such as the arm, waist or leg, (calf or thigh) under an outer garment, comprising a flexible belt member, preferably elastic, carrying on its front surface at least one pocket, e.g. weapon holster, the belt member being preferably provided with Velcro type closure means and of extra length with means permitting the wearer to remove enough of such length to fit her body part. In a preferred embodiment, a midriff belt member carrying two front weapon holsters is preferably adjustably and removably attached to a similar thigh belt member carrying weapon holster.

2 Claims, 2 Drawing Figures

Figure 1:
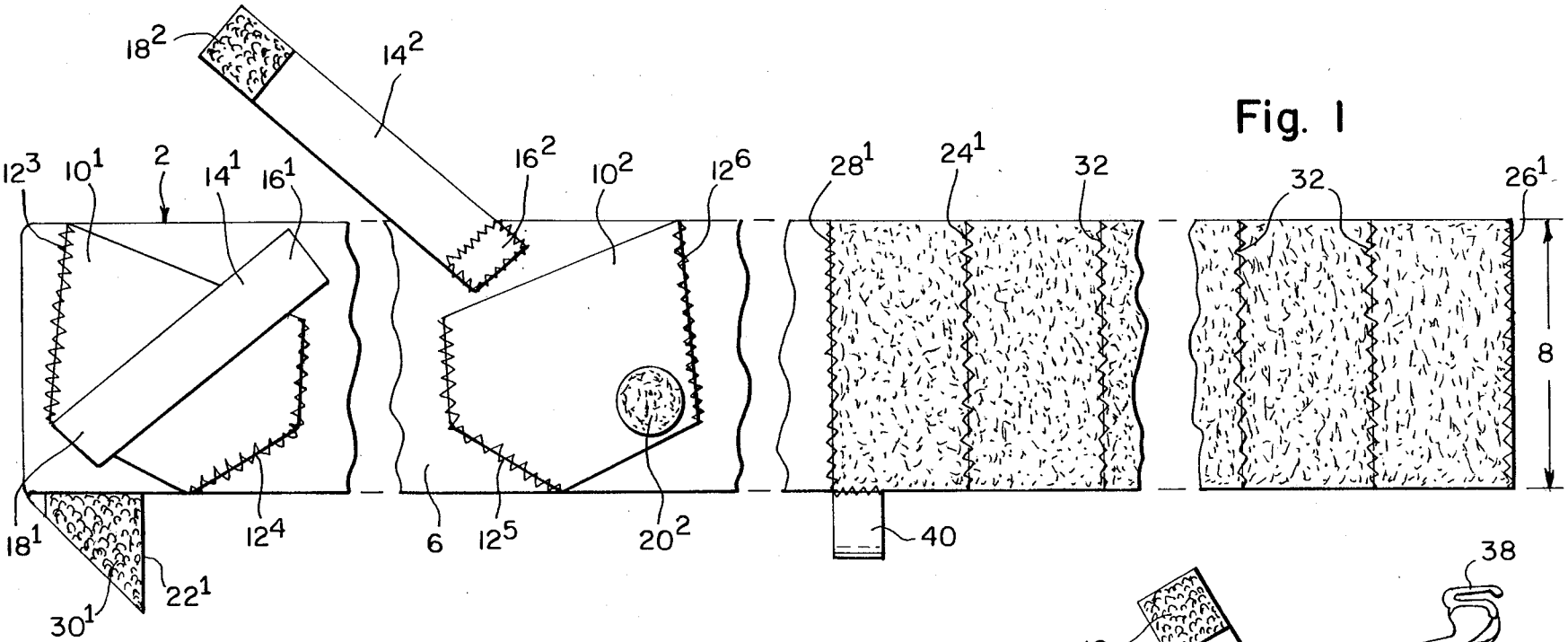

8
26¹
32
32
24¹
28¹
40
12⁶
20²
10²
16²
12⁵
6
14²
18²
16¹
14¹
12⁴
2
22¹
10¹
30¹
12³
18¹

38
34
30
36
12²
22
16
20
18
14
10
12¹
6
4
28
24
32
26
8

WEAPON HOLSTER CARRIER

This invention relates to a body pocket carrier, especially a weapon holster carrier, and more especially such a carrier to be worn on a female body part under an outer garment.

Numerous types of body pocket carriers have long been in existence for carrying weapons, money, jewelry or other items on the human body. Whether worn over or under an outer garment, most have been belt members designed for the male of the species and provided in varying predetermined lengths to accommodate the expected diversity of body part sizes, and with sundry fastening means for adjusting length and providing for excess length. Such fastening means have generally been bulky, cumbersome and/or more or less difficult to handle expeditiously. Most body pocket carriers have been undesirably heavy, cumbersome, bulky, more or less difficult to expeditiously attach and/or remove, and/or more or less unduly obstructive to ready access to the item carried in the pocket of the carrier. Other limitations and disadvantages of previously known body pocket carriers will become apparent as this description proceeds.

An object of this invention is the provision of a body pocket carrier which will not be subject to one or more of the above limitations and disadvantages. Another object of this invention is the provision of such a body pocket carrier provided with weapon holster pockets, especially gun holsters. Still another object of this invention is the provision of such a body pocket carrier especially for the female body. A further object of this invention is the provision of a system or combination of such body pocket carriers adapted for optional simultaneous use on a plurality of body parts. Other objects and advantages will appear as the description proceeds.

The attainment of one or more of the above objects is made possible by my invention which includes the provision of a body pocket carrier comprising a belt member of flexible sheet material at least wide enough to permit attachment to its outer surface of a pocket and at least long enough to encircle a human body part, one end of said belt member being provided with first fastening means for removable attachment to complementary fastening means at the other end of said belt member permitting snug fit encirclement thereof around said body part, at least one pocket being attached to the outer surface of said belt member.

According to further aspects of my invention:

the belt member is preferably more than long enough to permit overlapping attachment of said fastening means;

the fastening means preferably comprises flexible pile type means, preferably of the Velcro type wherein one of said pile type fastening means, preferably on the inner surface adjacent one end of said belt member, includes a multiplicity of hooks for overlapping engagement with complementary pile type fastening means, preferably on the outer surface adjacent to the other end of said belt member, including a multiplicity of cooperating loops to interlock with said hooks;

the length of the belt member is preferably substantially in excess of that sufficient to encircle the body part and said outer surface is provided with loop-bearing fastening means for a distance approximating said excess length extending from said other end, the sheet material being preferably fibrous and preferably firmly bound to the loop bearing fastening means along substantially vertical lines at spaced intervals along said excess length to prevent raveling when the belt member is cut adjacent the side of any such vertical line facing said other end in conformance with the size or circumference of the body part of the wearer, the fibrous sheet material being preferably elastic, especially woven elastic, and the pocket being preferably a weapon holster, e.g. for a handgun (revolver, semiautomatic pistol, etc.) or possibly a knife of dagger of the like;

a waist or midriff belt member preferably carries two weapon holster pockets, one on the front right side and the other on the front left side, each holster pocket being open at its top and bottom and comprising a swatch of flexible sheet material attached at its opposite upright (approximately vertical) edges to the belt member;

a thigh belt member similar to the aforesaid midriff belt member preferably carries on its front surface one similar weapon holster pocket and an adjustable length supporting strap, one end of which strap is secured to said thigh belt member at or adjacent an upper edge of said thigh belt member, the other end of which strap is provided with fastening means for removable attachment to or at the lower edge of a midriff belt member;

a safety strap is preferably provided adjacent each weapon holster pocket, one end of each such safety strap being secured to the belt member above and adjacent one side of the adjacent holster pocket, the other end of such safety strap being provided with fastening means for removable attachment to complementary fastening means on the lower surface of the other side of said adjacent holster pocket;

in combination, a body pocket carrier comprising a midriff belt member and a body pocket carrier comprising a thigh belt member as described above, the thigh belt member being provided with an adjustable length supporting strap which is removably attached to the midriff belt member as described above.

Figure 2:
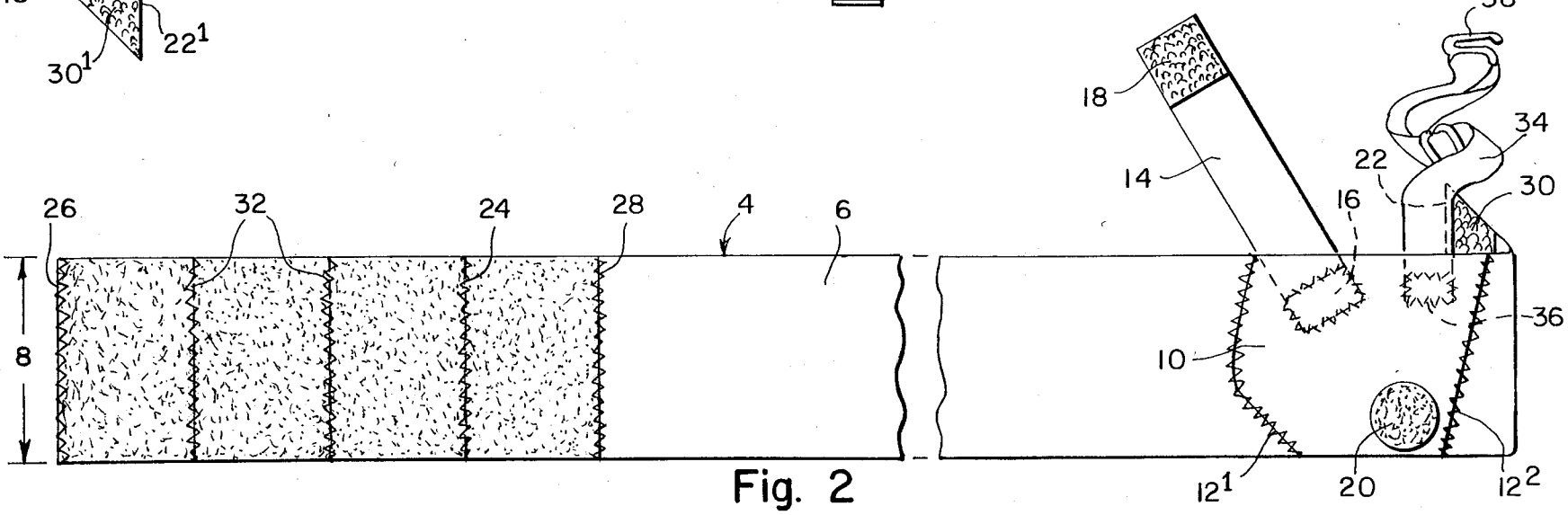

Preferred means of attainment of one or more of the aforesaid objects of this invention are explained in the following description and in the accompanying drawing in which:

FIG. 1 is a perspective front view of a preferred embodiment of a body pocket carrier according to my invention comprising a midriff belt member carrying two weapon holster pockets, and FIG. 2 is a perspective front view of a preferred embodiment of a body pocket carrier according to my invention comprising a thigh belt member carrying one weapon holster pocket.

In the two figures of the drawing, like reference characters identify like items. Midriff belt member 2 in FIG. 1 and thigh belt member 4 in FIG. 2 are formed of flexible sheet material 6, typically woven elastic fabric. Each belt member has a width 8 sufficient to permit attachment to its outer or front surface of a pocket, e.g. a weapon holster pocket 10, $\mathbf{10}^1$ and $\mathbf{10}^2$. As shown, each weapon holster pocket comprises a swatch of flexible sheet material, preferably like the belt member material, attached as by stitching at its opposite upright edges $\mathbf{12}^{1-6}$, e.g. by zigzag stitching to the outer surface (facing away from the body) of the belt member. The thigh belt member 4 in FIG. 2 carries one weapon holster pocket 10 and the midriff belt member 2 in FIG. 1 carries two weapon holster pockets, $\mathbf{10}^1$ on the right side (as worn on the body) and $\mathbf{10}^2$ on the left side, each pocket being open at its top and bottom. Adjacent each pocket is a safety strap 14, 14[1] and 14[2] of flexible sheet material, one upper end of which is secured, as by stitching, at respectively 16, 16[1] and 16[2] above and adjacent one side of the adjacent pocket, the other end of the safety strap respectively 18, 18[1] and 18[2], being provided (as by stitching) with fastening means, preferably as shown multiple hook-bearing Velcro flexible pile type, for removable attachment to complementary fastening means, respectively 20 and 20[2], preferably as shown multiple loop-bearing Velcro flexible pile type sewn or stitched on the lower surface of the other side of the adjacent pocket. In FIG. 1, safety strap 14[1] is shown in fastened position as it would be worn for safety purposes around the trigger guard or grip of a revolver or automatic pistol with the barrel protruding from the open lower edge of the pocket.

In view of the varying sizes (circumferences) of body parts of the wearers of the body pocket carriers of my invention, and for economic and other reasons, a single size (length) of belt member is provided for each body part, i.e. midriff, thigh, calf, arm, such size approximating the maximum expected size of the body part and substantially in excess of the approximate minimum expected size of such body part. Thus, the length of thigh belt member 4 in FIG. 2 from end 22 to line 24, and of midriff belt member 2 in FIG. 1 from end 22[1] to line 24, approximates such minimum expected sizes, the lengths from line 24 to end 26 in FIG. 2 and from line 24[1] to end 26[1] in FIG. 1 constituting such excess lengths or sizes. As shown, the outer surfaces of thigh belt member 4 in FIG. 2 from line 28 to end 26 and of midriff belt member 2 in FIG. 1 from line 28[1] to end 26[1] are provided with sewn on multiple loop-bearing Velcro flexible pile fastening means to which complementary multiple hook-bearing Velcro, flexible pile fastening means sewn or stitched at 30 and 30[1] to the inner surfaces adjacent ends 22 and 22[1] may be removably attached or fastened by pressing in overlapping engagement around the thigh or midriff. When the size (circumference) of the wearer's thigh is greater than length 22 to 24 in FIG. 2 and/or the size of the wearer's midriff is greater than length 22[1] to 24[1] in FIG. 1, the excess is readily removed as by cutting off the excess loop-bearing portions of the belt member adjacent ends 26 and/or 26[1]. To facilitate such a "sizing" operation and to prevent raveling, the fibrous sheet material of the belt member and the loop-bearing fastening material in such excess portions are firmly bound together, as by zigzag stitching, along substantially vertical lines, as at 32, at spaced intervals, e.g. 1.5" to 2.5", preferably about 2", and excess length in any particular instance would be removed as by cutting adjacent the side of any suitable vertical line 32 facing end 26 and/or 26[1].

As thus far described, the body pocket carrier on FIG. 2 could be worn on an upper arm or a calf of the leg, but when worn on the thigh of the leg, it is preferably provided with removable or non-removable supporting means for attachment to a concurrently worn midriff body pocket carrier to prevent the thigh body pocket carrier from slipping down the leg. For this purpose, the thigh body pocket carrier of FIG. 2 is provided with an adjustable length supporting strap 34 of flexible sheet material, such as elastic or preferably nonelastic fabric tape, one end of which is secured removably or preferably non-removably, as by stitching, at 36 at or adjacent the upper edge of the thigh belt member, the other end of which is provided with fastening means, e.g. hook 38 for removable attachment to or at the lower edge of the midriff belt member of FIG. 1, e.g. loop 40 of similar flexible sheet material stitched to the lower edge of the midriff belt member.

In a typical midriff body pocket carrier, referring to FIG. 1, the length from end 22[1] to end 26[1] is about 2 to 4 ft., preferably about 3 ft., the portion from 28[1] to 26[1] provided with removable fastening means is about 0.75 to 1.25 ft., preferably about 1 ft. or about one-third of the total length, the width of the complementary fastening means 30[1] at end 22[1] is about 1 to 2.5 inches, preferably about 2 inches, and the width 8 of the belt member is about 3 to 6 inches, preferably about 4 inches thereby further providing a desirable midriff cinching effect.

In a typical thigh body pocket carrier, referring to FIG. 2, the length from end 22 to end 26 is about 1.5 to 2.5 ft., preferably about 23 to 24 inches (2 ft.), the portion from 28 to 26 provided with removable fastening means is about 6 to 9 inches, preferably about 8 inches or about one-third the total length, the width of the complementary fastening means 30 at the end 22 is about 0.75–2 inches, preferably about 1 inch and the width 8 of the belt member is about 2 to 4 inches, preferably about 3 inches. Calf or arm carriers would have suitably smaller dimensions.

It will be understood that the attached drawing and the foregoing description thereof apply to a preferred embodiment of my invention, and that numerous modifications and variations thereof which will become obvious to those skilled in this art are to be included within the spirit and purview of this application and the scope of the appended claims. Some examples of such modifications and variations are described below. It will also be understood that the terms "upper", "lower", "inner", "outer", "right", "left", "front", "rear", "upright", "vertical", "above", etc. refer to positions on the upright human body.

Described removable fastening means may be replaced where suitable by similar means such as hook and eye, male and female snaps, boyonet and scabbard, button and hole or loop, etc. Elastic material may be replaced by non-elastic material and vice versa. Non-removable stitching fastening means may be replaced by heat-sealing, cementing, etc. Removable fastening means may be replaced by non-removable fastening means and vice versa. Positions of complementary Velcro type fastening means may be reversed. The flexible sheet material may be leather, plastic sheet or the like. The pockets could be made removable, especially one or both pockets on the midriff belt member. The pockets may be closed at the bottom for carrying jewelry, money or other valuables. The location of the removable fastening means at the ends of the midriff belt member may be rearranged to permit fastening the belt member in front between the pockets, e.g. weapon holsters. The carriers may be suitably ornamented with lace and/or ribbon or the like, especially for the female wearer.

The pocket body carriers of this invention may be made for and/or worn by male or female, child or adult, and over or under an article of outer apparel permitting ready access to the pockets, especially holsters for weapons often needed instantaneously for use in emergency.

I claim:

1. In combination, two pistol holster carriers for the female body, each carrier comprising a belt member of flexible elastic sheet material at least wide enough to permit attachment to its outer surface of at least one pistol holster and of a length substantially in excess of that sufficient to encircle a female body part, one end of said belt member carrying first flexible pile type fastening means, the other end of said belt member carrying over a length approximating said excess length extending from said other end complementary flexible pile type fastening means firmly bound to the sheet material of said belt member along substantially vertical lines at spaced intervals along said excess length so as to prevent raveling when the belt member is cut adjacent the side of any such vertical line facing said other end, one of said fastening means including a multiplicity of hooks and the other of said fastening means including a multiplicity of cooperating loops for removable interlocking attachment to the hooks when the two fastening means are pressed into overlapping engagement, one carrier comprising a midriff belt member carrying one pistol holster on its right side and another pistol holster on its left side, the other carrier comprising a thigh belt member carrying one pistol holster, each holster being open at its top and bottom and comprising a swatch of flexible elastic sheet material attached at its opposite upright edges to the outer surface of the respective belt member, one end of a safety strap of flexible elastic sheet material being secured to the outer surface of the belt member above and adjacent one side of each holster, the other end of said safety strap being provided with fastening means for removable attachment to complementary fastening means on the lower outer surface of the other side of said holster, and an adjustable length supporting strap of flexible sheet material, one end of which is secured to said thigh belt member at or adjacent an upper edge thereof, the other end of which is removably attached to said midriff belt member at or adjacent a lower edge thereof.

2. A pistol holster carrier combination according to claim 1 wherein the hook-bearing fastening means is on the inner surface adjacent each one end of said belt member for overlapping engagement with complementary loop-bearing fastening means on said outer surface adjacent the other end of said belt member.

* * * * *